US005463807A

United States Patent [19]

Hochhausl

[11] Patent Number: 5,463,807

[45] Date of Patent: Nov. 7, 1995

[54] ATTACHING MACHINE FOR ATTACHING FASTENERS

[75] Inventor: Anton Hochhausl, Helen, N.C.

[73] Assignee: Scovill Fasteners Inc., Clarkesville, Ga.

[21] Appl. No.: 303,208

[22] Filed: Sep. 8, 1994

[51] Int. Cl.[6] ..... B23Q 7/10

[52] U.S. Cl. ..... 29/809; 29/798; 29/818; 227/15; 227/18

[58] Field of Search ..... 29/771, 786, 787, 29/788, 790, 798, 809, 818, 243.5, 243.517, 243.518, 243.519, 243.529, 281.5, 283.5; 227/15, 16, 17, 18, 68, 135, 139, 149, 156

[56] References Cited

U.S. PATENT DOCUMENTS 937,150 10/1909 Havener ..... 227/55
4,615,473 10/1986 Taga ..... 227/15
4,645,110 2/1987 Taga ..... 227/15

FOREIGN PATENT DOCUMENTS 2107570 5/1983 United Kingdom ..... 29/788

*Primary Examiner*—David P. Bryant
*Attorney, Agent, or Firm*—Dallett Hoopes

[57] ABSTRACT

Attaching machine has readily removable upper and lower tool assembly which can be slid out of the machine frame when tools need to be changed. Tool assembly drive means is automatically connected as the new tool assembly is slid into final position.

12 Claims, 5 Drawing Sheets

ATTACHING MACHINE FOR ATTACHING FASTENERS

BACKGROUND OF THE INVENTION

This invention relates to attaching machines for attaching fasteners to textile or other foundation or substrate material, as for example, snap fasteners for articles of clothing and the like. More specifically, the invention relates to attaching machines having changeable tools.

In the past it has been common to attach snap fastener parts, for instance, a stud or socket, to apparel fabric, for instance, by pressing two of the fastener parts of a "set" together, fabric inbetween, so that the parts crimp together through the fabric in firm attachment. This pressing has been done on a setting or attaching machine of the type having a descending plunger which has engaged and carried the upper fastener part and a rising die which has engaged and carried the lower part. The fabric has remained more or less stationary. Such attaching machines have been around since at least early in this century. An example is shown in the old U.S Pat. No. 937,150 which issued Oct. 19, 1909 to Arthur R. Havener. Such machines have had automatic feeding of the fastener parts so that the parts feed down respective tracks to upper and lower receivers associated with the plunger and die respectively.

In the past when it became necessary to change operation from installing one pair of fastener parts to installing another pair, for instance, from a socket and prong ring to a stud and post, or to a tack and burr, or to change the size of the fastener parts, it was necessary to change the tools in the plunger and die so that the end contours of the tools mate perfectly with the associated fastener parts. Needless to say, the contents of hoppers and tracks associated with the upper and lower receivers have also had to be changed.

Changing tools has involved the manipulation of attaching machine parts and tools by an experienced operator or machinist and has taken up to half an hour. Care has had to be taken to see that the tools are properly oriented and aligned so that the subsequent setting of fastener parts comes off with no misalignments, mangling of parts, bad connections, etc.

It is an object of the present invention to provide means by which the changing of tools to accompany the changing of parts may be performed in virtually no time at all. In addition, under the new arrangement, the changing may be done readily by the attaching machine operator himself or by other relatively unskilled personnel.

BRIEF STATEMENT OF THE INVENTION

In the present invention the upper and lower tool assembly is integral and readily bodily disengageable from the feed and drive means and removable from its position in the support means so that it may be replaced by another upper and lower tool assembly adapted for use with different fastener parts.

More specifically, in the present invention support means carry an upper and lower tool assembly; upper and lower fastener part feed means; and pusher and tool drive means. The upper and lower tool assembly comprises an upper and a lower forward arm rigidly secured in spaced parallel relation by a bridging neck connecting the rear of the arms. The forward ends of the arms carry respectively the axially aligned upper punch and the lower die and the upper, and lower forward arms are horizontally slotted and slidably receive upper and lower pusher elements respectively. The feed means comprises removable hoppers and track which are hung on the support means and conduct the parts respectively to the pusher slots in the arms.

The upper and lower tool assembly is removably secured in an opening in the frame or support means and the tool drive means respectively releasably operatively engages the upper punch and the lower die and the pusher drive means releasably operatively engage the upper and lower pusher elements. Preferably, as the tool assembly is installed in its opening, the tool drive means automatically engages the punch and die.

By virtue of this structure, the integral upper and lower tool assembly can be released from the drive means and removed readily from its secured position in the support means and readily replaced by a different tool assembly to accommodate different fastener parts.

BRIEF DESCRIPTION OF THE DRAWINGS

Other objects and features of the invention will be apparent to those skilled in the art from a study of the following specification and the drawings, all of which disclose a non-limiting embodiment of the invention. In the drawings.

FIG. **4*a* is an enlarged fragmentary view of the operating body with one side plate removed and showing the tool and pusher drive means and the plunger and die in retracted position and the pushers in extended position.

DESCRIPTION OF THE PREFERRED EMBODIMENT

Figure 1:
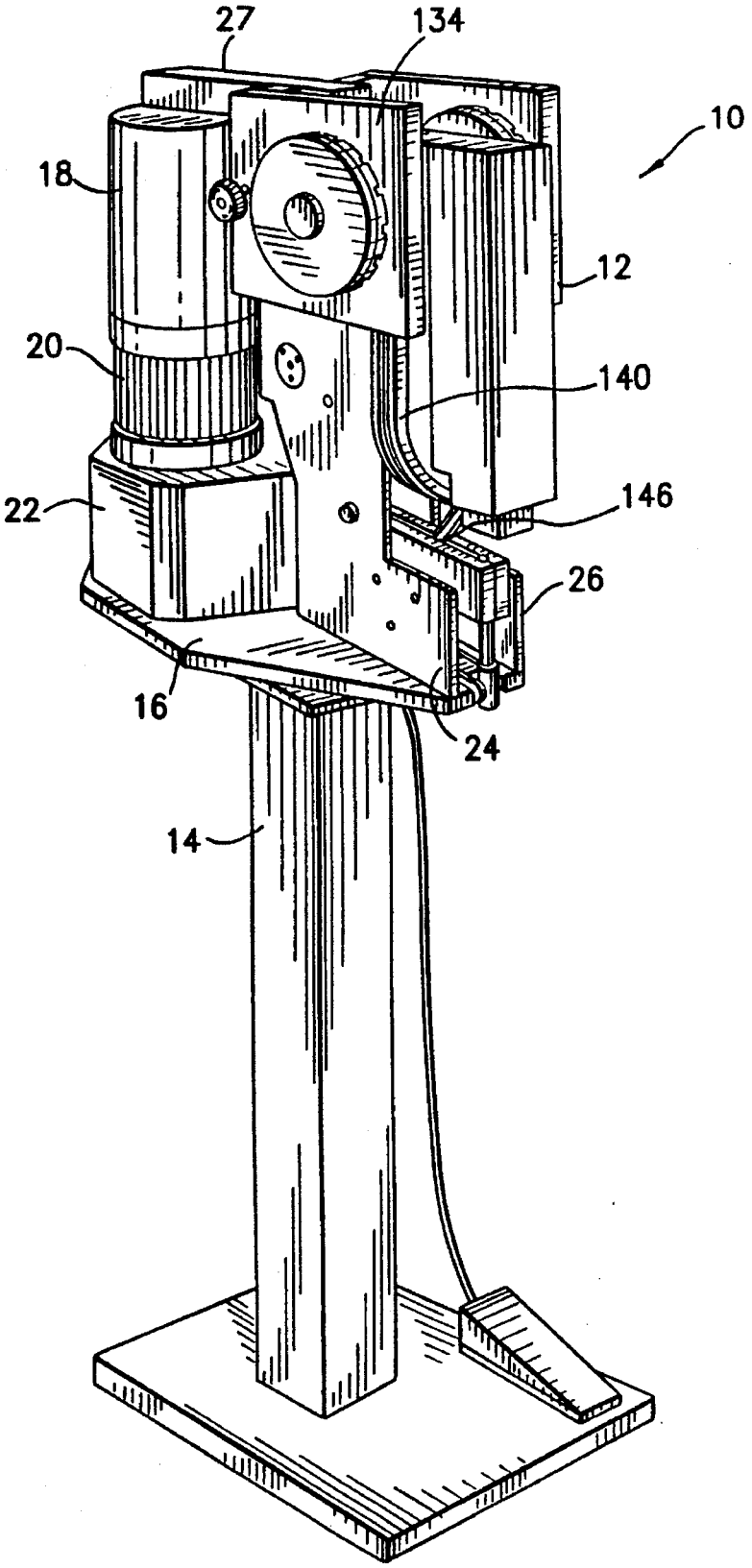
FIG. 1 is a perspective view of a setting machine embodying the invention.

An attaching machine embodying the invention is shown in FIG. 1 and generally designated 10. It comprises an operative body 12 having a narrow front and a big operating throat as will be described. The body is mounted on a supporting pedestal 14, preferably vertically adjustable.

The body 12 is defined partly by the horizontal bed plate 16. To the bed plate is secured a frame having spaced vertical side plates 24 and 26. The plates are held in spaced parallel relation by the base plate 16 and spacing wall 27. Adjacent the plate 24 is mounted the drive motor 18 having a downward shaft, a clutch compartment 20 and a power output box 22.

As shown in FIG. **4*a* stationary pivot shafts 28 and 30 bridge between the sidewalls and provide the fulcrums for the upper tool drive arm 32 and the lower tool drive arm 34 respectively. The drive arms are powered by a drive shaft 36 driven by the output from motor 18 by a timing-type belt 19. The arm 32 has a cam follower 38 on its inner end which follows a cam 40 keyed to the drive shaft 36. The arm is biased with the follower against cam 40 by spring means (not shown). The inner end of the arm 34 is connected to a shackle 42, to the bight of which is secured to a link encircling a drive disc 44 eccentrically mounted on the drive shaft 36. Thus, as the drive shaft 36 is rotated, the outer ends of the arms 32, 34** move rhythmically forward and away from each other.

To the outer ends of the arms 32 and 34 respectively are secured the yokes 46 and 48 respectively. The yoke 46 is secured to the arm 32 which is articulated at a pivot 52, and a gas cylinder 54, commercially available, resiliently urges the front end of the arm in a clockwise direction (FIG. 4*a*) about pivot 52 so that the plunger, in setting, can accommodate various thicknesses of foundation. To the front ends of the arms are rigidly secured respectively the drive yokes 46 and 48. As shown, the yokes 46 and 48 each comprise at their distal ends spaced parallel circular connecting pads.

Figure 3:
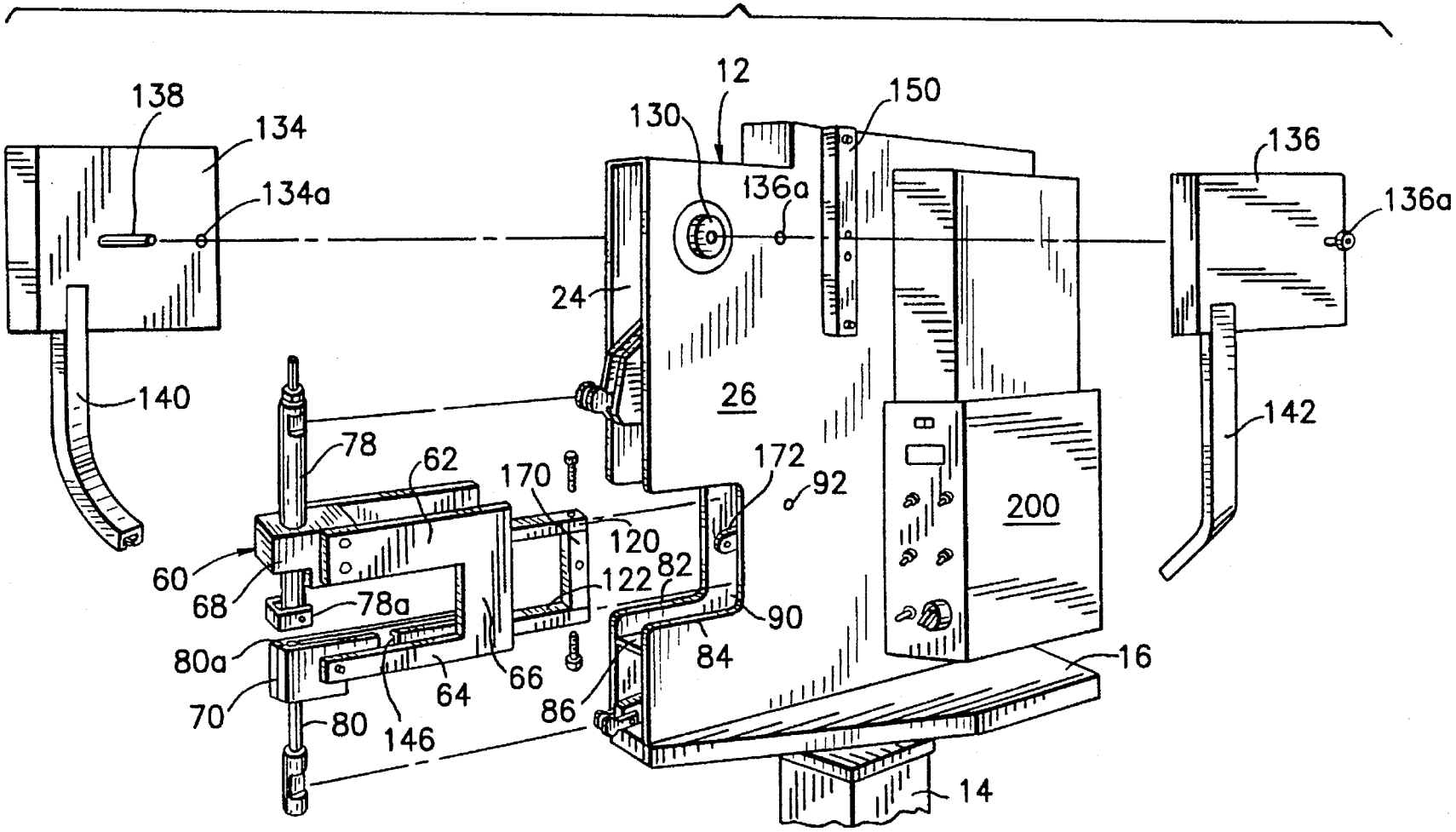
FIG. 3 is an exploded view in perspective of the operating body showing the upper and lower tool assembly removed from the drive and support means and the hoppers and their associated tracks also removed.

The upper and lower tool assembly is generally designated 60 and comprises the upper forward arm 62 and lower forward arm 64. These arms are held in spaced parallel relationship by a bridge 66. Ideally, as shown in FIG. 3, the upper and lower arms and bridge comprise a pair of sturdy C-shaped plates which are secured at least at their front ends (FIG. 3) to upper and lower spacing bosses 68 and 70 respectively. These bosses extend rearwardly to contain slots for their pushers as will be described. The bosses toward their front ends are vertically bored in alignment and receive appropriate and well-known bearing assemblies to reciprocably support the plunger assembly 78 and the die assembly 80. Hence, the term "boss" as used herein includes what may in an actual embodiment include many separate pieces.

The lower end of the plunger assembly is provided with a conventional upper receiver 78*a*, while the upper end of the die assembly is provided with a conventional lower receiver 80*a*.

As shown (FIG. 3) the side plates 24 and 26 are generously notched out as at 82 and 84 to give the machine a big throat. Spanning between the two plates is assembly support floor 86. The space between the walls 24 and 26 and above floor 86 define a tool assembly receiving opening 90 in the frame of the operating body 12. Bolts 92 through the walls 24, 26 secure the assembly in the opening 90.

The upper end of the plunger assembly 78 is provided with a connecting element 100 which is shaped like an "I" (FIG. 2) having a central web 102 and two outwardly extending flanges 104. The element is fixedly secured at the upper end of the plunger assembly 78. The spaced flanges 104 accommodate the yoke 46 between the two pads of which is slidingly disposed the web 102. Similarly, the lower end of the die assembly 80 is fixedly provided with a connecting element 110 also shaped like an "I" and having a central web 112 with spaced flanges 114. The two pads of the yoke 48 laterally embrace the central web 110.

The simple single-throw pusher arrangement of the preferred embodiment will now be described. As will be noted, the upper arm 62 and its boss 68 (FIG. 3) is longitudinally slotted (not shown) and reciprocably receives an upper pusher element 120, and the lower arm 64 and its boss 78 is also longitudinally slotted (not shown) and reciprocably receives a lower pusher element 122.

As is conventional, the slot (not shown) in the upper arm 62 and its boss 68 is in alignment with the upper receiver 78*a* when the plunger is raised so that when the pusher 120 extends forward, it will drive the upper fastener part into the upper receiver 78*a*. When subsequently the plunger drives down, it will, on its lower end, carry the part down for attachment. Similarly, the slot (not shown) in the lower arm 64 and its boss 78 is in alignment with the lower receiver 80*a* when the die is down so that when the pusher 122 extends forward, it will drive the lower fastener part into the lower receiver 80*a*. When subsequently the die drives up, it will, on its upper end, carry the lower part up for attachment. This is all as is conventional in the art.

An upper rotary drive head 130 (FIG. 3) is journaled for rotation in the plates 24, 26 and is driven by separate drive means (not shown). Preferably, the drive is "soft"; that is, slow, to avoid damaging the parts. Left and right hopper and track assemblies 134 and 136 are removably attached to the respective walls 24 and 26 by fasteners 134*a* and 136*a* comprising bolts threadedly received into openings in the respective walls. The hoppers have the pocketed rotating feed discs (not shown) well known in the art which are driven by shafts as 138 engaging into the rotary drive head 130.

The hoppers have associated therewith tracks 140 and 142 respectively which fit respectively into openings 144 and 146 (FIG. 2) in the upper and lower forward arms 62, 64 and the respective bosses in the upper and lower tool assemblies when the two hoppers 134, 136 are secured in, place on the walls 24, 26 respectively. The openings in the respective arms line up respectively with the pusher slots in the bosses above so that the tracks lead the parts directly into the slots in preparation for the forward thrust of the pushers all as described.

The hoppers 134, 136 are further supported by guides 150 secured to the plates 24, 26 to laterally stabilize the position of the respective hoppers 134, 136.

Figure 4A:
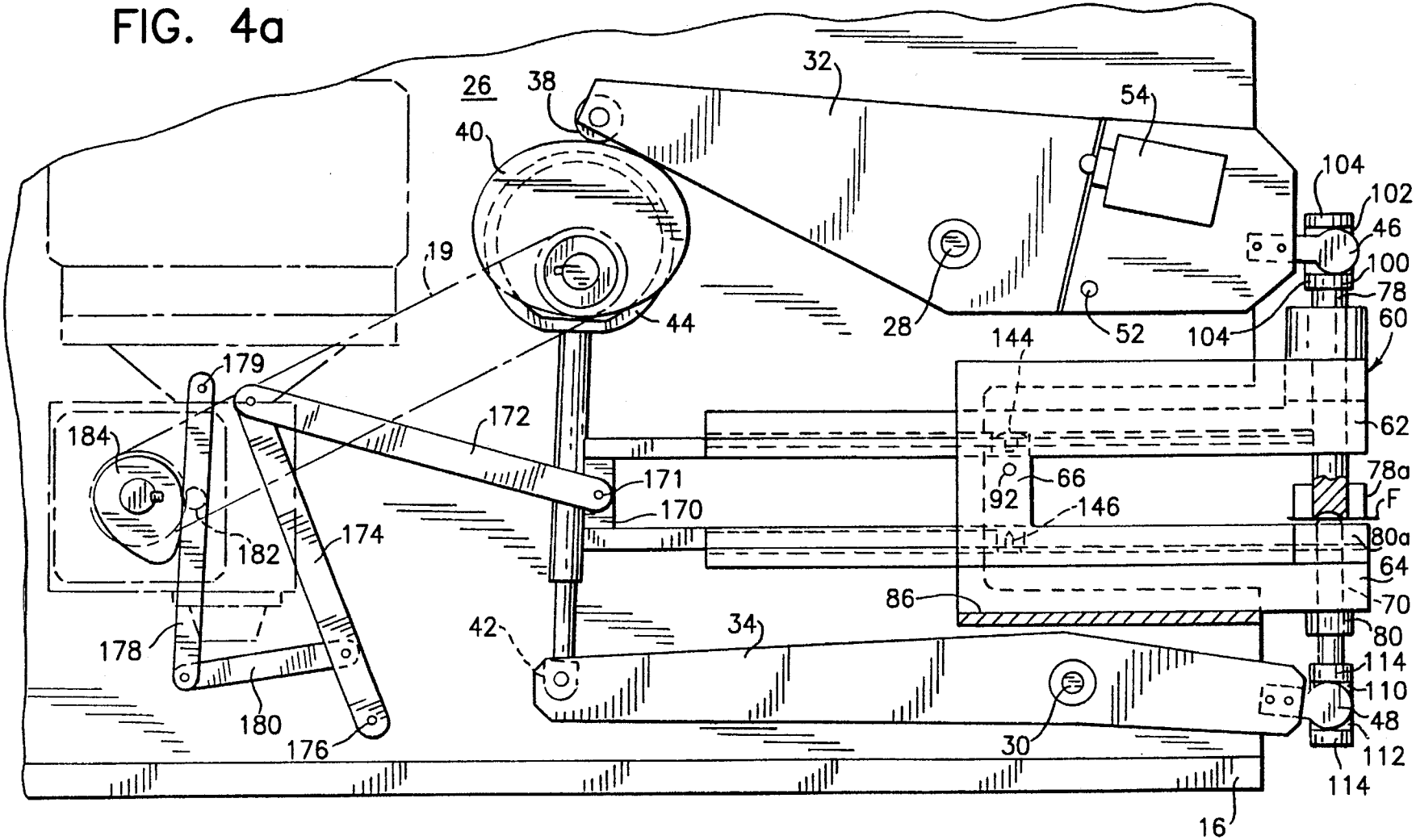
FIG. 4*b* is similar to FIG. 4*a*** but shows the tools being driven together to extended position setting fastener parts on fabric therebetween and the pushers in retracted position.
Figure 4B:
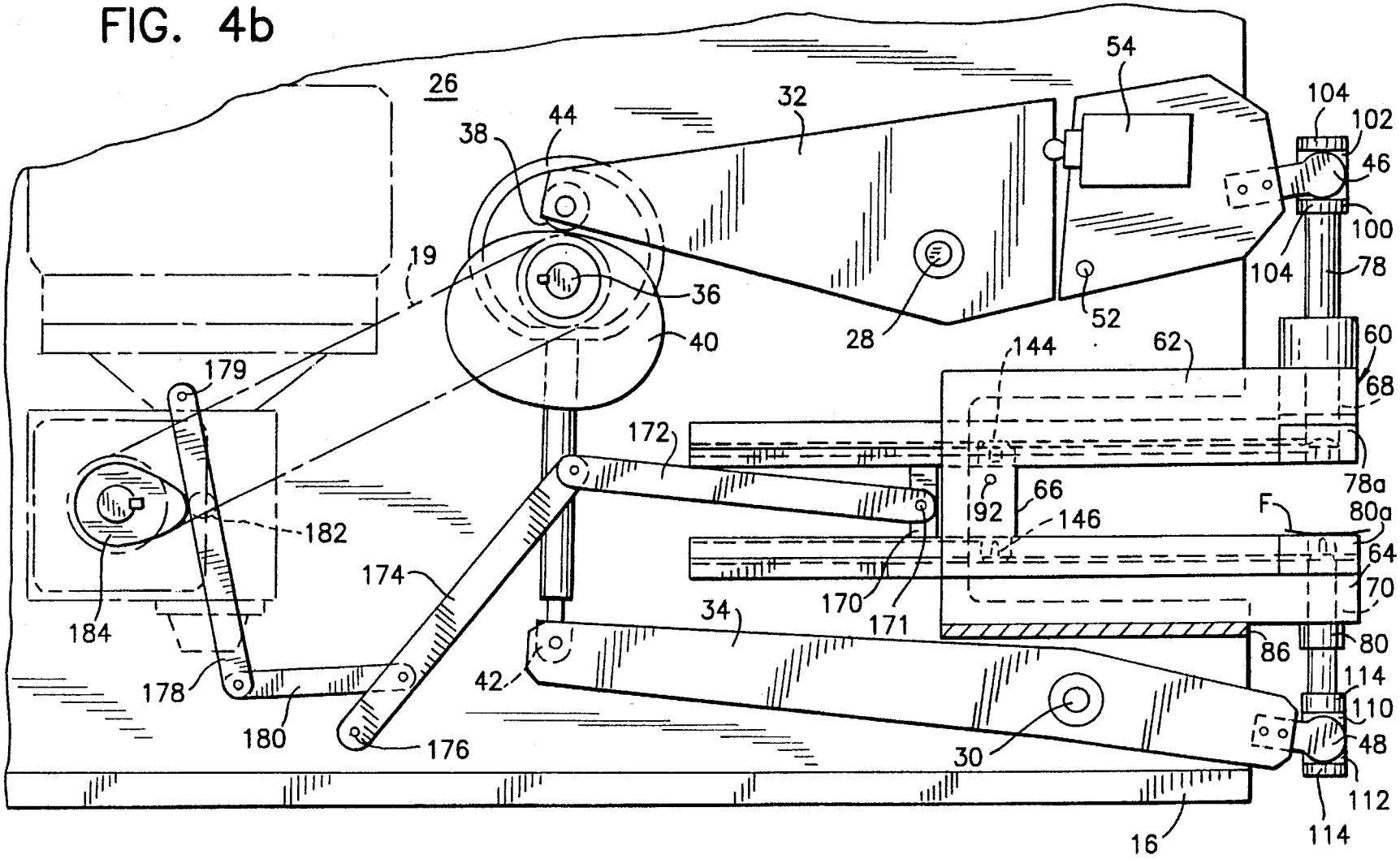

A pusher yoke 170 is disposed between the plates 24, 26 and is connected to the inward ends of the pushers 120, 122. As shown in FIGS. 4*a* and 4*b*, the yoke 170 is pivotally attached intermediate its ends to the end of a first rigid link 172. This in turn is attached at its other end pivotally to a second rigid link 174, the other end of link 174 is secured to a stationary pivot 176 secured to the frame (as one of the side walls) of body 12.

Link 174 is oscillated about pivot 176 to move the single-throw pushers 120, 122 in and out in suitable non-interfering cooperative relation with the rhythm of the tools as described. Oscillation is achieved by further linkages: the driven link 178 pivoted at its upper end to the frame at 179 and at its lower end is pivotally connected to intermediate link 180, the opposite end of which is pivotally connected to link 174 adjacent its lower end.

Intermediate its ends the driven link 178 is provided with a follower roller 182 which engages a cam 184 from the output box of motor 18. The face cam, as it rotates, drives the driven link 178 in oscillating fashion, and link 180, being connected to link 174 close to pivot 176, oscillates link 174 over a wide angle so that link 172 moves the pushers in and out at substantial relative speed and distance. Means (not shown) bias the link 178 toward cam 184.

The removal of the upper and lower tool assembly and its replacement with another assembly will now be described.

With the tool assembly 60 for a given set of fastener parts installed in the operating body 12, the change to another tool assembly for a different set of parts when indicated is readily accomplished. First, the feed assemblies 136, 134 are removed. Then the securing bolts 92 securing the tool assembly in the frame are removed. The assembly may be slid forwardly and the bolt 171 attaching the link 172 to the yoke 170 is removed to disengage the parts 170 and 172 (FIG. 3). The entire tool assembly 60 may then be withdrawn forwardly out of the opening 82 in the frame, the forward lower arm 68 sliding forward on the floor 86 just as a drawer might be opened and removed. The yokes 46, 48 being open in the front do not block the forward movement of the tools. The retiring tool assembly may be then placed in an appropriate tool cabinet or rack near the machine for later use.

Figure 2:
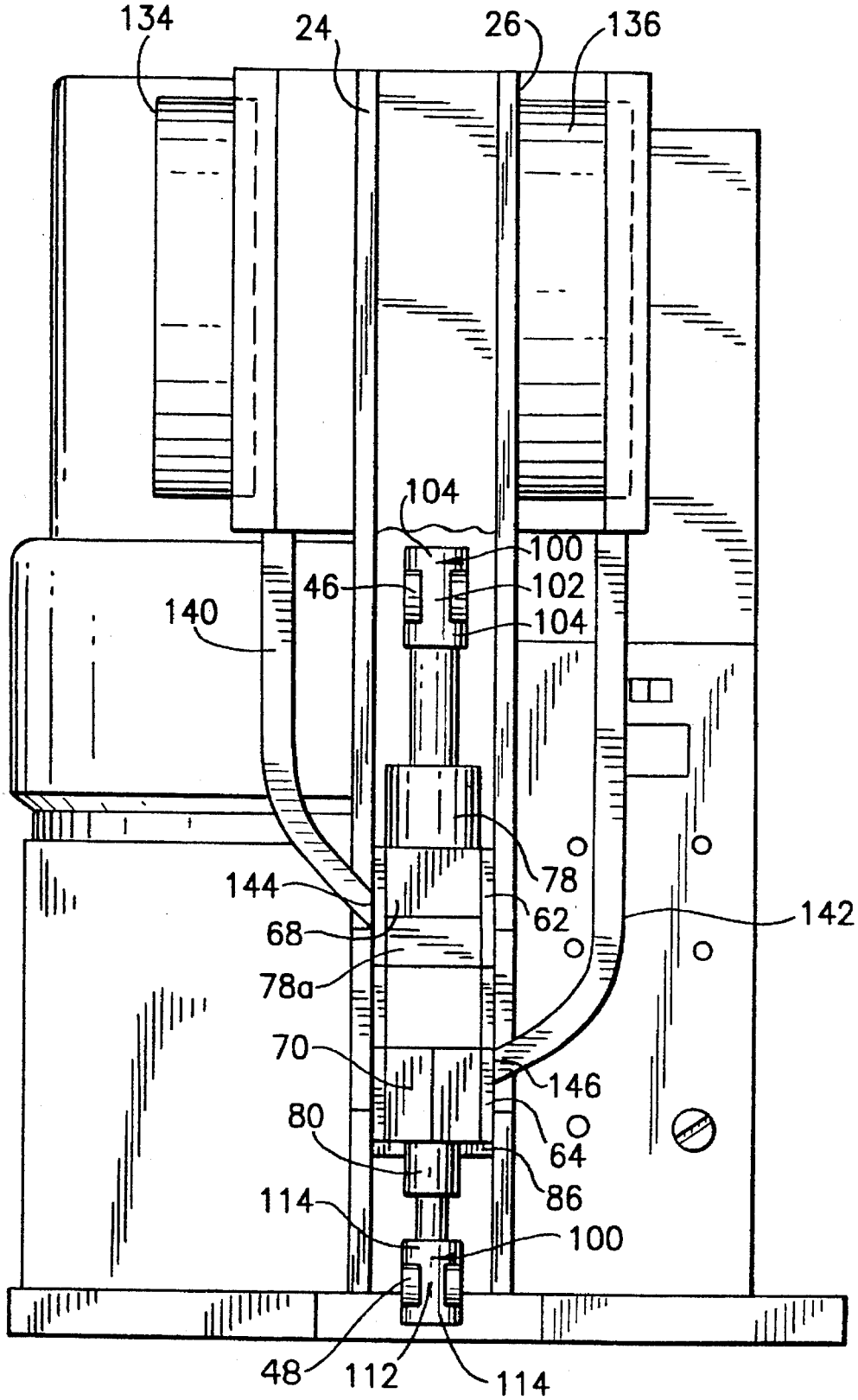
FIG. 2 is an enlarged front elevational view of the operating body of the machine with parts of the front cover broken away.

The tool assembly for the next operation is then taken out of the same cabinet and is installed into the opening 82, the lower forward arm 34 sliding on the floor 86. Before completion of the insertion of the new tool assembly, the bolt 171 is installed connecting the first link 172 to the pusher assembly. The tool assembly is shoved rearwardly, the webs 102, 110 being lined up with the yokes 48, 46 respectively (FIG. 2). As the tool assembly is shoved all the way into its opening, the yokes 46, 48 assume the relationship to the tools as shown in FIG. 4*a* and FIG. 2. The securing bolts 92 are reinstalled securing the new tool assembly in position in the frame. The feed assemblies carrying the new fastener parts are installed over the driving head 130 and secured by the bolts 136*a* as shown, the lower ends of the feeding tracks 140, 142 feeding into the respective openings 144, 146 in the arms 62, 64.

The setting machine of the invention is now ready to operate with the new parts.

Once the new tool assembly is installed, the operation of the setting machine of the invention is conventional. Parts from the respective tracks 140, 142 are fed one-by-one into the slots in the arms 62, 64 and their bosses in front of the pushers 120, 122 as is conventional. With the plunger and die in retracted position, the pushers are propelled forward by the linkages 178, 180, 174, 172 as described to deliver an individual part in each of the receivers 78*a* and 80*a* respectively (FIG. 4*a*). The pushers 120, 122 are then retracted out of the way by the linkages.

Next, the tool drive means comprising the eccentric 44 and the cam 40 drive the arms 32, 34 so that the plunger and die approach each other from opposite sides of the fabric F to engage the two parts with the fabric inbetween, securely setting the parts as shown. Thereafter the tool drive means separates the plunger and die ready for another cycle. Motor-activating and counting functions are done by controls in console 200.

The remarkable reduction in the length of time to change tools made possible by the new invention will be appreciated especially in view of the considerable cost of labor required to change and adjust tools in setting machines of the prior art. Such changes are frequent when runs are relatively short. The investment in additional tool assemblies required by the invention will be recognized by those skilled in the art as small considering the labor costs obviated by tool changing under the present invention.

For simplicity, the drawings and text hereof do not detail the structure or operation of the receivers and other parts which are, well known to those skilled in=the art and described in other patents including the Havener patent mentioned above. Instead, this specification and drawings focus on the invention.

Variations in the invention are possible without departing from the spirit of the invention. Thus, while the invention has been shown in only one embodiment, it is not so limited but is of a scope defined by the following claim language which may be broadened by an extension of the right to exclude others from making or using the invention as is appropriate under the doctrine of equivalents.

What is claimed is:

1. An attaching machine for attaching fastener parts to fabric comprising a frame having a horizontal opening in the front thereof, drive means on the frame, a separate vertically aligned plunger and die assembly having a horizontal rear portion selectively receivable into the horizontal opening for the purpose of supporting the assembly, and connection means on the drive means and the plunger and die assembly adapted to interengage when the rear portion of the plunger and die assembly is fully received in the opening.

2. An attaching machine as claimed in claim 1 wherein the connection means comprises a V-shaped yoke element on the drive means, the yoke element defined by spaced pads directed forwardly, and an I-shaped element on the plunger and die assembly, whereby as the rear portion of the tool assembly is horizontally slid into the opening, the web of the I-shaped element is received between the pads of the yoke element to operatively interengage them.

3. An attaching machine as claimed in claim 1 wherein the plunger and die assembly includes additionally vertically spaced parallel forward arms carrying the plunger and die respectively, pusher means in the arms respectively adapted to move parts from a supply into alignment with the plunger and die respectively, and the connection means includes selectively engageable means between the drive means and the pusher means.

4. An attaching machine for attaching upper and lower fastener parts to a foundation comprising:

a. an operating body including a frame, upper fastener part feed means and lower fastener part feed means removably mounted on the frame, tool drive means and pusher drive means secured in the frame and support means in the frame for an upper and lower tool assembly, b. an upper and lower tool assembly comprising an upper and a lower forward arm secured in spaced parallel relation by a rigid neck connecting the rear of the arms, the upper arm terminating forwardly in a vertically reciprocable plunger including an upper part receiver and a slidable upper pusher in the upper arm adapted when driven by the pusher drive means to move upper parts one-by-one from the upper fastener part feed means into the upper receiver; the lower arm terminating forwardly in a vertical die aligned with the plunger including a lower part receiver, and a slidable lower pusher in the lower arm adapted when driven by the pusher drive means to move lower parts one-by-one from the lower fastener part feed means into the lower receiver, c. first releasable connecting means connecting the tool drive means to the plunger and die and second releasable connecting means connecting the pusher drive means to the upper and lower pushers, whereby the upper and lower tool assembly can be releasably secured in the frame by the support means, the tool drive means and pusher driver means can be releasably connected to the plunger and die and the pushers respectively when the machine functions, and the assembly can be readily replaced by a different tool assembly to accommodate different fastener parts.

5. An attaching machine as claimed in claim 4 wherein the support means is in the form of a horizontal recess in the front of the frame and the upper and lower tool assembly is in the form of a rectangular body which slides drawer-like into the horizontal recess.

6. An attaching machine for attaching upper and lower fastener parts to a foundation comprising:

a. an operating body including a frame, upper fastener part feed means and lower fastener part feed means removably mounted on the frame, tool drive means and pusher drive means secured in the frame and support means in the frame for an upper and lower tool assembly, b. an upper and lower tool assembly comprising an upper and a lower forward arm secured in spaced parallel relation by a rigid neck connecting the rear of the arms, the upper arm terminating forwardly in a vertically reciprocable plunger assembly including an upper part receiver, and a slidable upper pusher in the upper arm adapted to move upper parts one-by-one from the upper fastener part feed means into the upper receiver; the lower arm terminating forwardly in a vertically reciprocable die assembly aligned with the plunger assembly including a lower part receiver, and a slidable lower pusher in the lower arm adapted to move lower parts one-by-one from the lower fastener part feed means into the lower receiver, and c. first releasable connecting means connecting the tool drive means to the upper plunger and the lower die, and second releasable connecting means connecting the pusher drive means and the upper and lower pushers, whereby the upper and lower tool assembly can be releasably secured in the frame by the support means, the tool drive means releasably connected to the upper plunger and lower die and the pusher drive means releasably connected to the pushers when the machine functions, and the assembly can be readily replaced by a different tool assembly to accommodate different fastener parts.

7. An attaching machine as claimed in claim 6 wherein the support means is in the form of a horizontal recess in the front of the frame and the upper and lower tool assembly is in the form of a rectangular body which slides drawer-like into the horizontal recess.

8. An attaching machine for attaching fasteners to a foundation comprising:

a. a machine head supporting upper fastener part feed means and lower fastener part feed means, tool drive means, pusher drive means and support means for an upper and lower tool assembly, b. an upper and lower tool assembly comprising an upper and a lower forward arm secured in spaced parallel relation by a bridging neck connecting the rear of the arms, the upper arm terminating forwardly in a vertical plunger bearing, said plunger bearing receiving a plunger, said plunger including an upper fastener part receiver at an end thereof, and a slidable upper pusher in the upper arm adapted to move upper parts one-by-one from the upper fastener part feed means into the upper receiver; the lower arm terminating forwardly in a vertical die bearing, said die bearing receiving a lower die, the lower arm carrying a lower fastener part receiver over the lower die, and a slidable lower pusher in the lower arm adapted to move lower parts one-by-one from the lower fastener part feed means into the lower receiver, c. releasable means connecting the tool drive means to the upper punch and the lower die, and d. releasable means connecting the pusher drive means and the upper and lower pushers, whereby the upper and lower tool assembly can be releasably secured in the head by the support means, the tool drive means releasably connected to the upper plunger and lower die and the pusher drive means releasably connected to the pushers when the machine functions, and the assembly can be readily replaced by a different tool assembly to accommodate different fastener parts.

9. An attaching machine as claimed in claim 8 wherein the support means is in the form of a horizontal recess in the front of the head and the upper and lower tool assembly is in the form of a rectangular body which slides drawer-like into the horizontal recess.

10. An attaching machine for attaching fastener parts to fabric comprising frame means, a separate vertically aligned plunger and die assembly, selectively engageable and disengageable horizontally directed support means on the frame means and on the separate plunger and die assembly, drive means on the frame means, and cooperant and selectively engageable and disengageable connection means on the drive means and the plunger and die assembly adapted to interengage when the support means on the frame means and on the plunger and die assembly are engaged.

11. An attaching machine for attaching fastener parts to fabric comprising:

a. a frame having horizontal opening means in the front thereof, b. drive means on the frame, c. a plunger assembly comprising a horizontal upper arm removably mounted in the opening means and terminating forwardly in a vertically reciprocable plunger including an upper part receiver and a slidable upper pusher in the upper arm adapted to move upper parts one-by-one into the upper part receiver, d. a die assembly comprising a horizontal lower arm removably mounted in the opening means and terminating forwardly in a vertically reciprocable die aligned with the plunger and including a lower part receiver and a slidable lower pusher in the lower arm adapted to move lower parts one-by-one into the lower part receiver and e. first releasable connecting means connecting the drive means to the plunger and die and second releasable connecting means connecting the drive means to the upper and lower pushers.

12. An attaching machine for attaching fastener parts to fabric comprising:

a. a frame having horizontal opening means in the front thereof, b. drive means on the frame, c. a plunger assembly comprising a horizontal upper arm removably mounted in the opening means and terminating forwardly in a vertically reciprocable plunger including an upper part receiver, d. a die assembly comprising a horizontal lower arm removably mounted in the opening means and terminating forwardly in a vertically reciprocable die aligned with the plunger and including a lower part receiver and e. releasable means connecting the drive means to the plunger and die.

* * * * *